United States Patent [19]

Fisher et al.

[11] 4,249,039

[45] Feb. 3, 1981

[54] DUAL-MODULATION RECEIVING APPARATUS

[76] Inventors: Charles B. Fisher, 2850 Hill Park Rd., Montreal, Quebec H3H 1T1, Canada; Sidney T. Fisher, 53 Morrison Ave., Mt. Royal, Montreal, Quebec H3H 1K3, Canada

[21] Appl. No.: 135,880

[22] Filed: Mar. 31, 1980

[51] Int. Cl.[3] ..... H04H 5/00

[52] U.S. Cl. ..... 179/1 GS; 179/1 GN

[58] Field of Search ..... 179/1 GS, 1 GB, 1 GN; 329/50, 167

[56] References Cited

U.S. PATENT DOCUMENTS

| | | | |
|---|---|---|---|
| 4,018,994 | 4/1977 | Kahn | 179/1 GS |
| 4,105,868 | 8/1978 | Takahashi et al. | 179/1 GS |
| 4,178,553 | 12/1979 | Fisher et al. | 325/487 |
| 4,182,932 | 1/1980 | Fisher et al. | 179/1 GS |

OTHER PUBLICATIONS

Don Mennie, "AM Stereo: Five Competing Options," *IEEE Spectrum,* Jun. 1978, pp. 26–28.

*Transmission Systems for Communications,* 4th Edition, Bell Laboratories, pp. 116, 117, 118 & 125–128.

P. F. Panter, *Modulation, Noise, and Spectral Analysis,* McGraw-Hill 1965, pp. 524–527.

*Reference Data for Radio Engineers,* Fifth Edition, Howard Sams, p. 21–14.

H. S. Black, *Modulation Theory,* New York 1953, p. 48.

S. Prigozy, "Zero-Crossing Detector Provides Fast Sync Pulses," *Electronics,* Apr. 19, 1965, p. 91.

T. R. Ferrara, "Delayed Pulse Generator," *EEE* 13:10, p. 71.

*Primary Examiner*—Douglas W. Olms

[57] ABSTRACT

Receiving apparatus, for a signal consisting of a carrier amplitude modulated by a first program and angle modulated by a second program, which delivers the programs separately and indicates a dual-modulation signal is being received, for use in a-m stereo and a-m dual-program systems.

2 Claims, 1 Drawing Figure

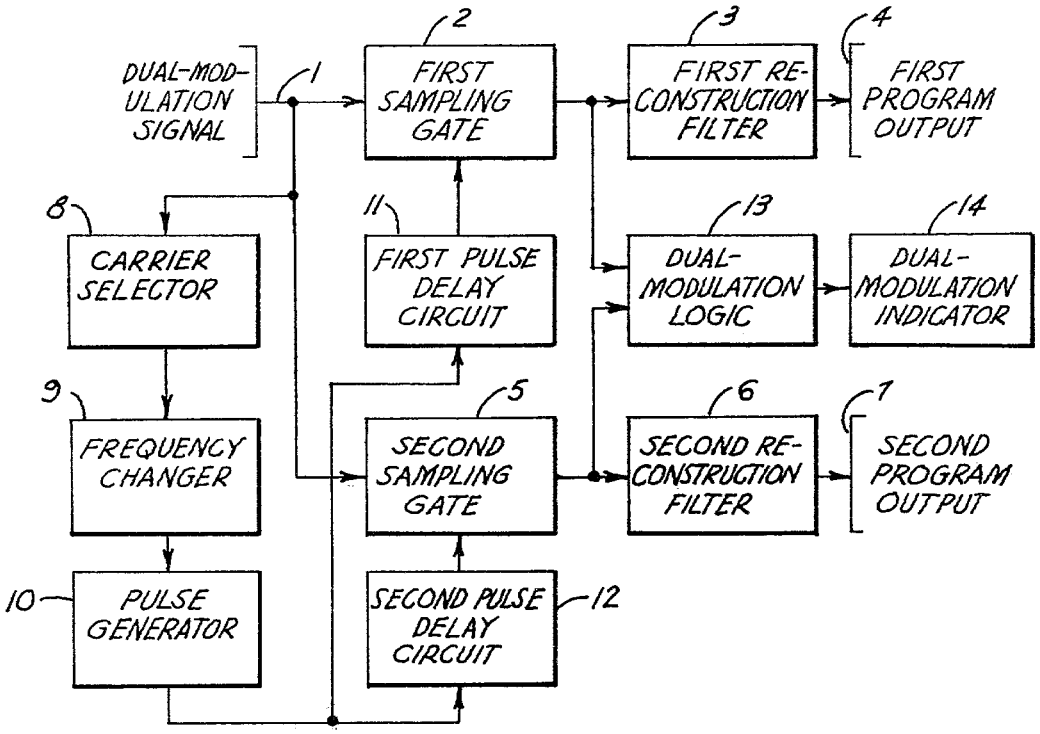
DUAL-MODULATION SIGNAL
1
2
FIRST SAMPLING GATE
3
FIRST RECONSTRUCTION FILTER
4
FIRST PROGRAM OUTPUT
8
CARRIER SELECTOR
11
FIRST PULSE DELAY CIRCUIT
13
DUAL-MODULATION LOGIC
14
DUAL-MODULATION INDICATOR
9
FREQUENCY CHANGER
5
SECOND SAMPLING GATE
6
SECOND RECONSTRUCTION FILTER
7
SECOND PROGRAM OUTPUT
10
PULSE GENERATOR
SECOND PULSE DELAY CIRCUIT
12

DUAL-MODULATION RECEIVING APPARATUS

BACKGROUND OF THE INVENTION

This invention relates to receiving apparatus for a carrier with dual modulation, which delivers the two modulating waves separately.

This invention discloses improvements in receiving apparatus of our U.S. Pat. No. 4,182,932, which include an optional reduce sampling rate as disclosed in our U.S. Pat. No. 4,178,553, a limited sampling pulse duration, a limited range of sampling frequencies, and the addition of an indicator of a dual-modulation signal. No other relevant prior art is known to us.

BRIEF SUMMARY OF THE INVENTION

General means for producing a dual-modulation signal, which can be used for either a-m dual-program or for compatible a-m stereo transmission, comprises modulating a carrier in an amplitude modulator with a first program (A+B), and modulating the carrier simultaneously in an angle modulator with a second program (A−B). An exactly equivalent dual-modulation signal is produced by amplitude modulating a first carrier with a first program (A), and amplitude modulating a second carrier of the same frequency as, but shifted in phase by less than 90° from, the first carrier, by a second program (B). Apparatus according to this invention receives such a dual-modulation signal and delivers each of programs (A) and (B) separately from the other program. Programs A and B may be different programs, may be the two channels of a single stereo program, A may be the sum of two different programs and B the difference of the two different programs, or A may be the sum of the two stereo channels of a single program and B the difference of the two channels. Matrixes for converting two given programs from one combination to another are well known.

The dual-modulation signal is sampled in a first gate, opened by regularly-occurring short pulses at a frequency greater than the minimum sampling or Nyquist frequency for the modulating waves, at instants of zero-crossings of the second carrier, and the resultant sequence of samples is reconstructed in a first filter which delivers the first modulating wave free from the second modulating wave. The second modulating wave is freed from the first modulating wave is produced by similar means.

The regularly-occurring short pulses are produced by a pulse generator and are delayed for each gate as stated above. The pulses are timed from the modulated carrier, freed from angle modulation in a carrier selection circuit, and divided in frequency by an integer.

A logic circuit senses the output of both gates and operates dual-modulation indicator means when sample sequences of materially different amplitude occur for short periods at the output of either gate, say for 100 ms.

BRIEF DESCRIPTION OF THE DRAWING

The drawing shows a simplified block schematic diagram of receiving apparatus according to the invention.

DETAILED DESCRIPTION OF THE INVENTION

This invention is based on several theorems as follows:

(1) An amplitude-modulated carrier has zero-crossings at the instants of zero-crossings of the same carrier without modulation.

(2) A band-limited signal sampled for short periods at regularly-occurring intervals with a sampling frequency greater than the minimum sampling or Nyquist frequency for the signal frequency band, produces a sequence of samples which fully defines the signal.

(3) A sequence of samples which defines a signal is reconstructed in the form of an analog replica of the signal, when passed through a filter having a bandwidth equal to, or in the case of a double-sideband amplitude-modulated wave one-half, the signal frequency band.

(4) The reconstruction of the sampled signal is entirely unaffected by the particular times at which the samples are taken, just so long as they are taken at perfectly regular intervals and at a high enough frequency. Advancing or delaying the sampling times need not advance, delay or otherwise affect the reconstructed signal.

(5) The Nyquist frequency for a signal is a discontinuous function of the signal bandwith and the highest signal frequency. For unstructured signals the Nyquist frequency varies between two and four times the signal bandwidth. For carriers double-sideband amplitude-modulated by a wave the Nyquist frequency varies from one to two times the modulated carrier bandwidth.

The drawing shows a simplified block schematic circuit diagram of receiving apparatus according to the invention. A dual-modulation signal appears on lead 1. This signal is a first carrier double-sideband amplitude-modulated by a first audio wave, and a second carrier double-sideband angle-modulated by a second audio wave. The first and second carriers are approximately the same amplitude, have the same frequency and are spaced in phase by an angle of more than 10° and less than 90°. The combined wave of the two modulated carriers is substantially equivalent to a single combined carrier double-sideband amplitude-modulated by a first linear function of the two audio modulating waves, and double-sideband angle-modulated by a second linear function of the two audio modulating waves, with no substantial sidebands outside the frequency band of the amplitude-modulation sidebands. Throughout this disclosure for ease of presentation we use the concept of two combined equal carriers of the same frequency and phased apart by 10° to 90°, double-sideband amplitude-modulated by different audio waves.

Lead 1 may be connected to the i-f output of a radio receiver, with an i-f frequency of 456 kHz, and is assumed to be so connected in this disclosure. In any case, a substantial amount of amplitude limiting must not occur between the formulation of the dual-modulation signal and its delivery to lead 1.

The dual-modulation signal on lead 1 is connected to first sampling gate 2, second sampling gate 5 and carrier selector 8. Sampling gate 2 is a well-known device, which is opened at regular intervals for short periods, preferably substantially less than one-half the period of the carrier, these periods centered as closely as practicable on zero-crossings of the second carrier on lead 1.

The pulse repetition frequency is greater than the minimum sampling or Nyquist frequency for the modulating waves of the dual-modulation signal on lead 1. The Nyquist frequency is a well-known function of the modulating wave bandwidth and the highest frequency in the modulating wave. The prior art shows values of the Nyquist frequency between two and four times the signal bandwidth for unstructured band-limited signals, and twice the highest frequency of the modulating wave for signals which are double-sideband amplitude-modulated carriers. The value of twice the highest frequency of the modulating wave may be used for the Nyquist frequency for the sampling gates of this invention.

The output of first sampling gate 2 is a sequence of samples of the dual-modulation wave, taken for periods centered on zero-crossings of the second carrier, and thus of zero-crossings of the amplitude-modulated second carrier. Hence the output of gate 1 consists of a sequence of samples of the first modulated carrier. The sampling frequency is greater than the Nyquist frequency for the first modulating wave, and is also equal to the carrier frequency divided by an integer. These sampling frequencies result in a sequence of samples of the first modulated carrier which fully define the first modulating wave.

By a well-known sampling theorem such a sequence of samples of a band-limited signal is reconstructed as an accurate analog replica of the signal by a low-pass filter with the bandwidth of the highest modulating frequency, subject to alteration only by the delay and frequency distortion in the pass-band of the reconstruction filter, as shown by Panter, Modulation, Noise, and Spectral Analysis, McGraw-Hill 1965, pages 525 and 526. For example, if the carrier frequency is 456 kHz and the highest first audio frequency is 16 kHz, the modulated carrier frequency band is 440 to 472 kHz, and the dual-modulation signal may be sampled at a frequency of 32.571 kHz or higher, and modulating wave reconstructed in a low-pass filter with a cut-off frequency of 16 kHz.

In the drawing the output of sampling gate 1 is delivered to first reconstruction filter 3 and from filter 3 to first program output 4 as described above. In a similar manner second sampling gate 5 is opened at regular intervals for short periods centered on zero-crossings of the first carrier on lead 1 at the same frequency as the sampling frequency of gate 2.

The output of gate 5 consists of a sequence of samples of the second modulated carrier, which fully define the second modulating wave, and are reconstructed as an accurate analog replica of the second modulating wave by second reconstruction filter 6.

The dual modulation signal on lead 1 is delivered to carrier selector 8, where by means of one or more of selective circuits, filters and a synchronized oscillator the combined carrier is freed from noise and sidebands. Such a selector is well-known in the prior art.

The output of carrier selector 6 is led through frequency changer 9 to pulse generator 10, both well-known devices of the prior art, designed so that the output of pulse generator 10 consists of a series of regularly-occurring short pulses with a repetition frequency greater than the minimum sampling or Nyquist frequency for the modulating waves, and equal to the carrier frequency of the dual-modulation signal divided by an integer.

The output of pulse generator 10 is delayed in first pulse delay circuit 11 so that each pulse is centered in time one an instant of one zero-crossing of the combined carrier on lead 1, and is delayed in second pulse delay circuit 12 so that each pulse is centered in time on an instant of one zero-crossing of the combined carrier on lead 1.

Other means of providing correctly timed pulses to gates 2 and 5 are well-known, such as delivering the output of frequency changer 9 to separate phase shifters and pulse generators for each of the sampling gates.

The outputs of each sampling gate 2 and 5 are delivered separately to dual-modulation logic circuit 13. This circuit observes the amplitude of pulses received at each input, and prevents activation of an output lead to dual-modulation indicator 14, which may be a lamp, when pulse sequences of less than normal amplitude are received at the input. This is the case when only one amplitude-modulated wave is present on lead 1. Obviously the dual-modulation logic circuit 13 may be omitted, within the scope of the invention. The duration of low pulse amplitude may be averaged over a period of 20 to 200 ms, with 100 ms a satisfactory value.

We claim:

1. Receiving apparatus for a dual-modulation signal equivalent in waveform to a first carrier double-sideband amplitude-modulated by a first modulating wave, combined with a second carrier approximately equal in amplitude to, equal in frequency to, and spaced in phase by more than 10° and less than 90° from, said first carrier, double-sideband amplitude-modulated by a second modulating wave, producing a dual-modulation signal, which comprises:

first sampling means which samples said dual-modulation signal at regularly-occurring intervals, for short periods substantially centered in time on instants of zero-crossings of said second carrier at said first sampling means, with a sampling frequency greater than the minimum sampling or Nyquist frequency for said first modulating wave and equal to said first carrier frequency divided by an integer, and second sampling means which samples said dual-modulation signal at regularly-occurring intervals, for short periods substantially centered in time on instants of zero-crossings of said first carrier at said second sampling means, with a sampling frequency equal to said sampling frequency of said first sampling means, and first filter means which has a pass-band the same as the frequency band of said first modulating frequency, which receives the output of said first sampling means and delivers the output of said first filter means to a first output circuit, and second filter means which has a pass-band the same as the frequency band of said second modulating wave, which receives the output of said second sampling means and delivers the output of said second filter means to a second output circuit, and pulse generator means comprising carrier frequency selection means, frequency changing means and pulse timing means, which receives said dual-modulation signal, and generates a first sequence of regularly-occurring pulses with short duration substantially centered in time on zero-crossings of said second carrier at said first sampling means, with a repetition frequency greater than the minimum sampling or Nyquist frequency of said first modulating wave, and equal to said first carrier frequency divided by an integer, and delivers said first sequence of pulses as gating pulses to said first sampling means, and generates a second sequence of regularly-occurring pulses with short duration, substantially centered in time on zero-crossings of said first carrier at said second sampling means, with a repetition frequency equal to the repetition frequency of said first sequence of pulses, and delivers said second sequence of pulses as gating pulses to said second sampling means, and dual-modulation indicator means which actuates signalling means, and which receives the output of said first sampling means at a first input and the output of said second sampling means at a second input, and which comprises logic means which compares the pulse amplitudes at each of said inputs with the normal pulse amplitudes, and disables said signalling means when said pulse amplitudes at either of said inputs are not substantially equal to the normal pulse amplitudes with a dual-modulation signal.

2. Receiving apparatus in accordance with claim 1 which comprises:

first sampling means which samples said dual-modulation signal when gating pulses are received at a gating input of said first sampling means, and second sampling means which samples said dual-modulation signal when gating pulses are received at a gating input of said second sampling means, and first filter means which has a pass-band the same as the frequency band of said first modulating wave, which receives the output of said first sampling means and delivers the output of said first filter means to a first output circuit, and second filter means which has a pass-band the same as the frequency band of said second modulating wave, which receives the output of said second sampling means and delivers the output of said second filter means to a second output circuit, and carrier selector means which receives said dual-modulation signal and which comprises selective circuits which pass the carrier of said dual-modulation signal and substantially stop the passage of waves of other frequencies, and frequency changer means which receives the output of said carrier selector means and divides said output in frequency by an integer, and pulse generator means which receives the output of said frequency changer means and produces a sequence of regularly-occurring pulses of short duration with a repetition frequency greater than the minimum sampling or Nyquist frequency of said first modulating wave and equal to the carrier frequency of said dual-modulation signal divided by an integer, and first pulse delay means which receives the output of said pulse generator means and delays each pulse of the sequence of pulses in said output so that said pulse is substantially centered in time on a zero-crossing of the second carrier in said dual-modulation signal, and delivers said pulse to said gating input of said first sampling means, and second pulse delay means which receives the output of said pulse generator means and delays each pulse of the sequence of pulses in said output so that said pulse is substantially centered in time on a zero-crossing of the first carrier in said dual-modulation signal, and delivers said pulse to said gating input of said second sampling means, and dual-modulation indicator means which actuates signalling means, and which receives the output of said first sampling means at a first input and the output of said second sampling means at a second input, and which comprises logic means which disables said signalling means when said pulse amplitudes at either of said inputs are substantially lower than said pulse amplitudes when a dual-modulation signal is received over a period of approximately 100 ms.

* * * * *